US005853569A

United States Patent [19]

Aldous et al.

[11] Patent Number: 5,853,569

[45] Date of Patent: Dec. 29, 1998

[54] METHOD FOR MANUFACTURING A PROCESS OIL WITH IMPROVED SOLVENCY

[75] Inventors: Keith K. Aldous, League City; Jacob Ben Angelo, Spring, both of Tex.; Joseph Philip Boyle, Baton Rouge, La.

[73] Assignee: Exxon Research and Engineering Company, Florham Park, N.J.

[21] Appl. No.: 988,416

[22] Filed: Dec. 10, 1997

[51] Int. Cl.[6] ..... C10G 21/00

[52] U.S. Cl. ..... 208/212; 208/312; 208/314; 208/315; 208/318

[58] Field of Search ..... 208/212, 312, 208/314, 315, 318

[56] References Cited

U.S. PATENT DOCUMENTS

| | | | |
|---|---|---|---|
| 3,904,507 | 9/1975 | Mills | 208/14 |
| 3,925,220 | 12/1975 | Mills | 252/578 |
| 3,928,168 | 12/1975 | Mills et al. | 208/14 |
| 4,085,036 | 4/1978 | Murphy, Jr. et al. | 208/212 |
| 4,311,583 | 1/1982 | Woodle | 208/312 |
| 4,353,794 | 10/1982 | Winter, III et al. | 208/321 |
| 4,592,832 | 6/1986 | Bristow et al. | 208/309 |

*Primary Examiner*—Walter D. Griffin
*Attorney, Agent, or Firm*—Joseph J. Dvorak

[57] ABSTRACT

A method for producing a process oil is provided in which a napthenic rich feed is enriched with an aromatic extract oil. The enriched feed is then subjected to a solvent extraction thereby providing a process oil.

8 Claims, 1 Drawing Sheet

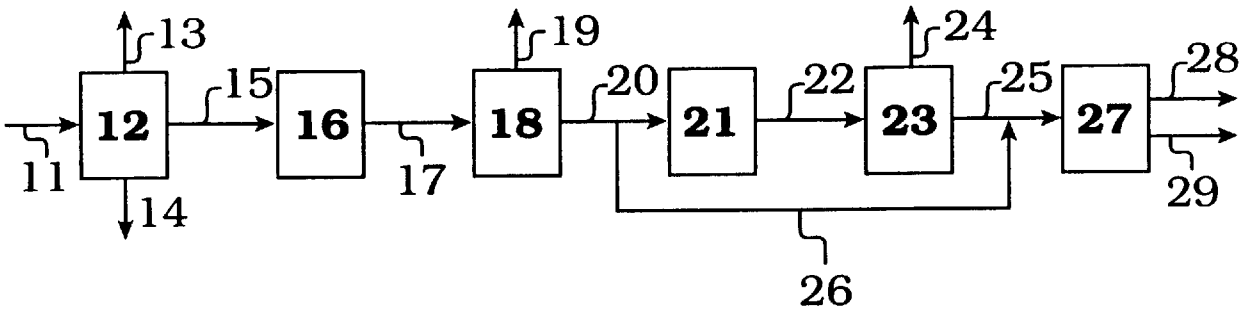
11
12
13
14
15
16
17
18
19
20
21
22
23
24
25
26
27
28
29

METHOD FOR MANUFACTURING A PROCESS OIL WITH IMPROVED SOLVENCY

FIELD OF THE INVENTION

This invention is concerned with improved process oils and their method of preparation.

BACKGROUND OF THE INVENTION

A product line of light (135 SSU@100° F.), intermediate (1000 SSU@100° F.), and heavy (3000 SSU@100° F.) hydrofinished process oils are currently manufactured from the corresponding distillates of Gulf Coastal naphthenic crude oils. These products are known as Coastal Pale Oils (CPOs) and are used extensively as rubber extender oils. A parallel product line of Solvent Extracted Coastal Pale Oils (SECP) are also produced via solvent extraction of the same naphthenic crude distillates. The raffinates are used as general process oils while the extracts are downgraded to cat cracker feedstock.

End users of CPOs are requesting increased solvency of the products as indicated by a lower aniline point for a given viscosity grade. Simultaneously, the availability and quality of the Gulf Coast naphthenic crude oils is declining. Thus there is a need for a process which can produce CPOs and SECPs simultaneously, produce CPOs of higher solvency, require less naphthenic distillate for a given product make, and utilize lower quality Gulf Coast naphthenic crude oils.

SUMMARY OF THE INVENTION

Very simply stated, one embodiment of this invention comprises enriching a hydrotreated naphthenic distillate with an aromatic extract oil and thereafter solvent extracting the enriched distillate to provide a process oil.

In a particularly preferred embodiment of the present invention the aromatic extract oil is obtained by solvent extracting a portion of a hydrotreated naphthenic distillate.

These and other embodiments of the present invention will become apparent upon reading the Detailed Description in conjunction with the accompanying drawing.

BRIEF DESCRIPTION OF THE DRAWING

The accompanying FIGURE, is a simplified process flow diagram illustrating a preferred embodiment of the subject invention in which an initial naphthenic feedstock is passed via line 11 into a pipestill 12 where it is distilled. Volatile overheads and bottoms are taken off via lines 13 and 14 respectively. A naphthenic rich stream from the pipestill is fed through line 15 to a hydrotreating reactor 16 for hydrotreatment. The hydrotreated naphthenic distillate is passed via line 17 to a separation stage 18 where ammonia and hydrogen sulfide are removed via line 19. A portion of the hydrotreated naphthenic distillate is passed via line 20 to a solvent extraction unit 21. The aromatic extract oil is removed from solvent extraction unit 21 via line 22 where it is sent to the stripping zone 23 for removal of solvent via line 24. The aromatic extract oil is passed through line 25 and combined with a second portion of the hydrotreated naphthenic distillate from line 26 to provide a mixture which is extracted in a second liquid extraction unit 27 to provide a process oil removed via line 28 and extract removed via line 29.

DETAILED DESCRIPTION OF THE INVENTION

Typically the naphthenic crude feedstock used is fed to a pipestill to produce a suitable naphthenic distillate useful in the present invention. Depending upon the operating parameters of the pipestill various cuts of naphthenic distillates can be obtained, each of which can be processed according to the invention; however, for simplicity, the present invention will be described in detail with respect to a single naphthenic distillate.

As indicated in the FIGURE, a naphthenic distillate is treated in a first hydrotreating stage to convert at least some of the sulfur and nitrogen present in the distillate to ammonia and hydrogen sulfide. Preferably the first hydrotreating stage is maintained within a temperature range of about 300° C. to 375° C. and more preferably within the range of about 340° to 365° C., a hydrogen partial pressure in the range of about 300 to 2500 psia and preferably in the range of about 500 to 1200 psia. The hydrotreating is usually done at a space velocity (v/v/hr) in the range of about 0.1 to 2 v/v/hr.

The catalyst used in hydrotreating is not critical. It may be any one of those known and used in the art such as nickel sulfides, cobalt sulfides, molybdenum sulfides, and tungsten sulfides and combinations of these.

After hydrotreating the naphthenic distillate, hydrogen sulfide and ammonia formed during the hydrotreating stage are removed by any convenient means from the feed. For example, the hydrotreated material may be passed to a stripping vessel and an inert stream such as steam can be used to strip the hydrogen sulfide and ammonia from the hydrotreated material by using techniques well-known in the art.

In accordance with the present invention, an aromatic extract oil is added to the hydrotreated naphthenic distillate to provide feed for further processing. Preferably the aromatic extract oil will have an aniline point of less than 40° C. in the case of light grades and less than 70° C. in the case of heavier grades. The properties for three typical grades of distillates are shown in Tables 1, 2 and 3.

TABLE 1

HYDROFINED DISTILLATE AND EXTRACT
LIGHT GRADE: 135

| | | Hydrofined Distillate | Extract From Hydrofined Distillate |
|---|---|---|---|
| Viscosity | SSU 100° F. | 116.2 | 225.7 |
| Viscosity | SSU 210° F. | 39.3 | 42.5 |
| Viscosity Index | VI | 34.8 | −57.8 |
| Spec Gravity | 60° F. | 0.8957 | 0.9599 |
| API Gravity | 60° F. | 26.5 | 15.9 |
| Aniline Point | °F. (°C.) | 178.0 (81.1) | 99.7 (37.6) |
| Sulfur | wt % | 0.20 | 0.64 |
| Basic Nitrogen | ppm | 71 | 266 |
| Total Nitrogen | ppm | 262 | 951 |
| Pour Point | °F. | −22 | −22 |
| ASTM Color | ASTM | 1.5 | 2.0 |
| Clay Gel | | | |
| Saturates | wt % | 63.7 | 25.9 |
| Aromatics | wt % | 35.7 | 72.0 |
| Polars | wt % | 0.6 | 2.1 |
| COC Flash | °F. | 350 | 380 |
| GCD | | | |
| 5 LV % | °F. | 568 | 586 |
| 50 LV % | °F. | 721 | 708 |
| 95 LV % | °F. | 835 | 820 |
| HPLC | | | |
| Saturates | wt % | 65.7 | 31.1 |
| 1-Ring Aromatics | wt % | 20.4 | 30.9 |
| 2-Ring Aromatics | wt % | 8.2 | 21.3 |
| 3+ Ring Aromatics & Polars | wt % | 5.7 | 16.7 |

TABLE 2

HYDROFINED DISTILLATE AND EXTRACT INTERMEDIATE GRADE 1000

| | | Hydrofined Distillate | Extract From Hydrofined Distillate |
|---|---|---|---|
| Viscosity | SSU 100° F. | 725.4 | 2602.8 |
| Viscosity | SSU 210° F. | 63.8 | 86.2 |
| Viscosity Index | VI | 46.6 | −65.0 |
| Spec Gravity | 60° F. | 0.9171 | 0.9667 |
| API Gravity | 60° F. | 22.8 | 14.9 |
| Aniline Point | °F. (°C.) | 195.4 (91) | 135.5 (57.5) |
| Sulfur | wt % | 0.32 | 0.70 |
| Basic Nitrogen | ppm | 240 | 575 |
| Total Nitrogen | ppm | 762 | 1568 |
| Pour Point | °F. | 21 | |
| ASTM Color | ASTM | 2.0 | 3.0 |
| Clay Gel | | | |
| Saturates | wt % | 56.8 | 29.4 |
| Aromatics | wt % | 40.7 | 65.6 |
| Polars | wt % | 2.5 | 5.0 |
| COC Flash | °F. | 470 | 470 |
| GCD | | | |
| 5 LV % | °F. | 723 | 711 |
| 50 LV % | °F. | 863 | 840 |
| 95 LV % | °F. | 973 | 947 |
| HPLC | | | |
| Saturates | wt % | 58.9 | |
| 1-Ring Aromatics | wt % | 20.8 | |
| 2-Ring Aromatics | wt % | 10.5 | |
| 3+ Ring Aromatics & Polars | wt % | 9.7 | |

TABLE 3

HYDROFINED DISTILLATE HEAVY GRADE: 3000

| | | |
|---|---|---|
| Viscosity | SSU 100° F. | 1787.7 |
| Viscosity | SSU 210° F. | 98.1 |
| Viscosity Index | VI | 53.7 |
| Spec Gravity | 60° F. | 0.9219 |
| API Gravity | 60° F. | 22.0 |
| Aniline Point | °F. (°C.) | 210 (100) |
| Sulfur | wt % | 0.46 |
| Basic Nitrogen | ppm | 401 |
| Total Nitrogen | ppm | 1168 |
| Pour Point | °F. | |
| ASTM Color | ASTM | 3.0 |
| Clay Gel | | |
| Saturates | wt % | 55.4 |
| Aromatics | wt % | 40.2 |
| Polars | wt % | 4.4 |
| COC Flash | °F. | |
| GCD | | |
| 5 LV % | °F. | 778 |
| 50 LV % | °F. | 958 |
| 95 LV % | °F. | 1065 |
| HPLC | | |
| Saturates | wt % | 54.1 |
| 1-Ring Aromatics | wt % | 20.1 |
| 2-Ring Aromatics | wt % | 11.8 |
| 3+ Ring Aromatics & Polars | wt % | 14.0 |

Such an aromatic oil suitable in the process of the present invention is readily obtained by extracting a naphthenic distillate with aromatic extraction solvents in extraction units known in the art. Typical aromatic extraction solvents include n-methyl pyrrolidone, phenol, n-n-dimethylformamide, dimethylsulfoxide, methylcarbonate, morpholine, furfural, and the like. Preferably, n-methylpyrrolidone or phenol is used as the solvent. Solvent to oil treat volume ratios are generally from about 1:1 to about 3:1. The extraction solvent preferably contains water in the range of about 1 volume % to about 20 volume %. Extraction temperatures are generally in the range of about 40° C. to about 80° C. Basically the extraction can be conducted in a counter-current type extraction unit. The resultant aromatic rich solvent extract stream is then solvent stripped to provide an aromatic extract oil having an aromatic content of about 40% to 90% by weight. Properties for two typical extract oils are given in Tables 1 and 2.

In a particularly preferred embodiment of the present invention, the aromatic oil is obtained by extracting a hydrotreated naphthenic distillate. Indeed it is particularly preferred in the practice of the present invention to produce the aromatic extract oil by utilizing a portion of the same hydrotreated naphthenic distillate that is to be enriched.

In any event, the aromatic extract oil is then mixed with a hydrotreated naphthenic distillate in the extract to distillate volume ratio in the range of about 10:90 to about 90:10.

The resultant mixture is then subjected to a solvent extraction using typical aromatic extraction solvents at solvent to oil volume treat ratios of about 0.5:1 to about 2:1. The extract solvent contains from about 1 volume % to about 30 volume % water. Extraction temperatures are in the range of about 40° C. to about 80° C.

As is shown herein the present invention has been found to produce a process oil having a substantially reduced aniline point and hence, increased solvency. Moreover, by enriching the naphthenic distillate with aromatic extract oil and re-extracting the admixture in accordance with the present invention, a substantially greater amount of process oil is obtained then when just distillate is employed.

COMPARATIVE EXAMPLE 1

In this Comparative Example, a naphthenic feedstock having a viscosity of 135 SSU at 100° F. was passed through two hydrotreating stages under the conditions outlined in Table 4 below.

TABLE 4

| PROCESS VARIABLE | PASS 1 | PASS 2 |
|---|---|---|
| Temperature, °C. | 355 | 315 |
| $H_2$ Partial Pressure, psia | 550 | 655 |
| Gas Treat, SCF $H_2$/Barrel | 450 | 450 |
| Space Velocity, V/V/HR | 0.7 | 0.7 |

In this Comparative Example after hydrotreating under the conditions of stage 1 the material is stripped to remove hydrogen sulfide and ammonia. The product of the second stage represents a process oil having the properties shown in Table 5, Column 1, below.

TABLE 5

| Properties | Comparative Example 1 | 50% Extract Example 1 |
|---|---|---|
| Specific Gravity, 60/60° F. | 0.8928 | 0.9100 |
| Aniline Point, °F. | 179 | 159 |
| Sulfur, wt. % | 0.11 | 0.23 |
| Viscosity, 100° F., SSU | 119 | 148 |

TABLE 5-continued

| Properties | Comparative Example 1 | 50% Extract Example 1 |
|---|---|---|
| HPLC-2, wt. % | | |
| Saturates | 69.8 | 56.9 |
| 1-ring aromatics | 21.9 | 28.5 |
| 2-ring aromatics | 5.9 | 10.1 |
| 3+ ring arom. & Polars | 2.4 | 4.5 |
| Mutagenicity Index | 0 (Pass) | 0 (Pass) |
| IP 346, wt. % | 3.2 | |

EXAMPLE 1

In this Example a napthenic feedstock corresponding to that used in the Comparative Example 1 was passed through a single hydrotreating stage under the conditions set forth under Pass 1 of Table 4. The hydrotreated distillate was extracted using 9.2% water and phenol in a countercurrent extraction column in a treat ratio of 170% and at a temperature of 145° F. After removal of the solvent, the aromatic extract oil was combined with an equal amount by weight of hydrotreated distillate and the mixture was extracted using 9.7% water in NMP at a treat ratio of 110% and at a temperature of 55° C. After removal of the solvent a process oil having the properties set forth in Table 5, Column 2 was obtained.

This invention allows simultaneous production of CPOs and SECPs from given naphthenic distillates. Using the extract stream from the SECP allows increased solvency of the CPO which in turn allows use of lower quality naphthenic crude, and increases overall product (CPO+SECP) yield. The product derived from the distillate/extract blend passed the mutagenicity test. Assuming equal volumes of SECP and CPO products from a given distillate this invention reduces distillate requirements by 20%.

COMPARATIVE EXAMPLE 2

In this Comparative Example, a naphthenic feedstock having a viscosity of 1000 SSU at 100° F. was passed through two hydrotreating stages under the conditions outlined in Table 4 above.

In this Comparative Example after hydrotreating under the conditions of stage 1 the material is stripped to remove hydrogen sulfide and ammonia. The product of the second stage represents a process oil having the properties shown in Table 6, Column 1, below.

TABLE 6

| Properties | Comparative Example 2 | 50% Extract Example 2 |
|---|---|---|
| Specific Gravity, 60/60° F. | 0.9135 | 0.9230 |
| Aniline Point, °F. | 199.6 | 188.6 |
| Sulfur, wt. % | 0.20 | 0.32 |
| Viscosity, 100° F., SSU | 700.8 | 931.3 |
| HPLC-2, wt. % | | |
| Saturates | 62.5 | 51.6 |
| 1-ring aromatics | 21.8 | 27.7 |
| 2-ring aromatics | 9.7 | 13.1 |
| 3+ ring arom. & Polars | 6.1 | 8.5 |
| Mutagenicity Index | 0 (Pass) | 0 (Pass) |
| IP 346, wt. % | 3.4 | 2.0 |

EXAMPLE 2

In this example, a naphthenic feedstock corresponding to that used in the Comparative Example 2 was passed through a single hydrotreating stage under the conditions set forth under Pass 1 of Table 4. The hydrotreated distillate was extracted using 2.4% water in phenol in a countercurrent extraction column in a treat ratio of 190% and at a temperature of 175° F. After removal of the solvent, the aromatic extract oil was combined with an equal amount by weight of hydrotreated distillate and the mixture was extracted using 7.0% water in NMP at a treat ratio of 110% and at a temperature of 66° C. After removal of the solvent a process oil having the properties set forth in Table 6, Column 2 was obtained.

This invention allows simultaneous production of CPOs and SECPs from given naphthenic distillates. Using the extract stream from the SECP allows increased solvency of the CPO which in turn allows use of lower quality naphthenic crude, and increases overall product (CPO+SECP) yield. The product derived from the distillate/extract blend passed both the mutagenicity test and the IP-346 (AMES) screening test for cancer potential of oil. Assuming equal volumes of SECP and CPO products from a given distillate this invention reduces distillate requirements by 20%.

COMPARATIVE EXAMPLE 3

In this Comparative Example, a naphthenic feedstock having a viscosity of 3000 SSU at 100° F. was passed through two hydrotreating stages under the conditions outlined in Table 4 above.

In this Comparative Example after hydrotreating under the conditions of stage 1 the material is stripped to remove hydrogen sulfide and ammonia. The product of the second stage represents a process oil having the properties shown in Table 7, Column 1, below.

TABLE 7

| Properties | Comparative Example 3 | 50% 1000 CH Extract Example 3 |
|---|---|---|
| Specific Gravity, 60/60° F. | 0.9197 | 0.9230 |
| Aniline Point, °F. | 211.1 | 203 |
| Sulfur, wt. % | 0.31 | 0.38 |
| Viscosity, 100° F., SSU | 1839.7 | 1574 |
| HPLC-2, wt. % | | |
| Saturates | 55.6 | 49.8 |
| 1-ring aromatics | 22.2 | 26.7 |
| 2-ring aromatics | 11.5 | 13.5 |
| 3+ ring arom. & Polars | 10.7 | 10.0 |
| Mutagenicity Index | 0.8 (Pass) | 0.2 (Pass) |
| IP 346, wt. % | 3.4 | 1.9 |

EXAMPLE 3

In this example, an intermediate (1000 SSU@100° F.) naphthenic feedstock corresponding to that used in the Comparative Example 2 was passed through a simple hydrotreating stage under the conditions set forth under Pass 1 of Table 4. The hydrotreated distillate was extracted using 2.4% water and phenol in a countercurrent extraction column in a treat ratio of 190% and at a temperature of 175° F. After removal of the solvent, the aromatic extract oil was combined with an equal amount by weight of heavy (3000 SSU@100° F.) hydrotreated distillate and the mixture was extracted using 7.0% water in NMP at a treat ratio of 110% and at a temperature of 66° C. After removal of the solvent a process oil having the properties set forth in Table 7, Column 2 was obtained.

This invention allows simultaneous production of CPOs and SECPs from given naphthenic distillates. Using the extract stream from the SECP allows increased solvency of the CPO which in turn allows use of lower quality naphthenic crude, and increases overall product (CPO+SECP) yield. The product derived from the distillate/extract blend passed both the mutagenicity test and the IP-346 (AMES) screening test for cancer potential oil. Assuming equal volumes of SECP and CPO products from a given distillate this invention reduces distillate requirements by 20%.

What is claimed is:

1. A method for producing a process oil comprising:

hydrotreating a naphthenic rich feed at a temperature of from about 300° C. to about 375° C., a hydrogen partial pressure of 300 to 2500 psia and a space velocity of 0.1 to 2 (v/v/hr) to provide a hydrotreated feed;

removing hydrogen sulfide and ammonia from the hydrotreated feed to provide in a stripped hydrotreated feed;

adding an aromatic extract oil to the stripped hydrotreated feed in a volume ratio ranging between about 10% to 90% to provide an enriched feed; and, solvent extracting the enriched feed to provide a process oil.

2. The method of claim 1 wherein the aromatic extract oil has an aromatic content of about 40% to 90% by weight.

3. The method of claim 2 wherein the aromatic extract oil is obtained by solvent extracting a portion of the stripped hydrotreated feed.

4. The method of claim 3 wherein the enriched feed is solvent extracted with an aromatic extraction solvent at a solvent to feed volume ratio of from about 0.5:1 to about 2:1 and at a temperature of about 40° C. to about 80° C.

5. A method for producing a process oil comprising:

hydrotreating a napthenic rich feed at a temperature of from about 300° C. to about 375° C., a hydrogen partial pressure of 300 to 2500 psia and a space velocity of 0.1 to 2 (v/v/hr) to provide a hydrotreated feed;

removing hydrogen sulfide and ammonia from the hydrotreated feed to provide a stripped feed;

dividing the stripped feed into a first part and a second part;

solvent extracting the first part with an aromatic extraction solvent to provide an extract;

removing the solvent from the extract to provide an aromatic extract oil;

adding the aromatic extract oil to the second part to provide an enriched feed; and solvent extracting the enriched feed to provide a process oil.

6. The method of claim 5 wherein the first part is extracted at a solvent to first part volume ratio of from about 1:1 to about 3:1 at a temperature of about 40° C. to about 80° C.

7. The method of claim 6 wherein the aromatic extract oil is added to the second part in a volume ratio from about 10% to about 90%.

8. The method of claim 7 wherein the enriched feed is solvent extracted with an aromatic extraction solvent at a solvent to feed volume ratio of from about 0.5:1 to about 2:1 at a temperature of about 40° C. to about 80° C.

* * * * *